US007612758B2

(12) United States Patent
Yang

(10) Patent No.: US 7,612,758 B2
(45) Date of Patent: Nov. 3, 2009

(54) BRIGHTNESS CONTROL METHOD AND DEVICE FOR A DISPLAY

(75) Inventor: Ho-Hsing Yang, Hsinchu (TW)

(73) Assignee: Sunplus Technology Co., Ltd., Hsinchu (TW)

( * ) Notice: Subject to any disclaimer, the term of this patent is extended or adjusted under 35 U.S.C. 154(b) by 722 days.

(21) Appl. No.: 11/311,320

(22) Filed: Dec. 20, 2005

(65) Prior Publication Data

US 2006/0238485 A1 Oct. 26, 2006

(30) Foreign Application Priority Data

Apr. 21, 2005 (TW) ..... 94112664 A

(51) Int. Cl.
*G09G 3/36* (2006.01)

(52) U.S. Cl. ..... 345/102; 345/87; 345/204; 345/690; 382/168

(58) Field of Classification Search ..... 345/55, 345/76, 77, 82, 83, 84, 87, 102, 204, 690; 382/168, 169, 170, 171, 172
See application file for complete search history.

(56) References Cited

U.S. PATENT DOCUMENTS

| | | | | |
|---|---|---|---|---|
| 6,388,388 | B1 * | 5/2002 | Weindorf et al. | 315/169.3 |
| 7,375,719 | B2 * | 5/2008 | Oh et al. | 345/102 |
| 7,460,103 | B2 * | 12/2008 | Konno et al. | 345/102 |
| 2002/0027617 | A1 * | 3/2002 | Jeffers et al. | 348/587 |
| 2005/0231457 | A1 * | 10/2005 | Yamamoto et al. | 345/102 |

* cited by examiner

*Primary Examiner*—My-Chau T Tran
(74) *Attorney, Agent, or Firm*—Bacon & Thomas, PLLC

(57) ABSTRACT

A brightness control method and device for a display, which calculates a brightness distribution of partial frame image, determines when the partial frame image tends to be dark or light, compares a backlight brightness of the display with a predetermined value in accordance with the partial frame image determined, and accordingly adjusts the backlight brightness of the display.

6 Claims, 3 Drawing Sheets

BRIGHTNESS CONTROL METHOD AND DEVICE FOR A DISPLAY

BACKGROUND OF THE INVENTION

1. Field of the Invention

The invention relates to the technical field of planar display and, more particularly, to a brightness control method and device for a display.

2. Description of Related Art

Currently, with the development of electronic technology, portable electronic products such as mobile phones, personal digital assistants (PDA), and MP3 players are getting more and more popular. Such products typically have a small screen with a panel. The panel can be a liquid crystal display (LCD), an organic light-emitting diode (OLED) or other typical planar displays. However, such products are only equipped with cells, which provide limited power. To overcome this drawback, these products typically adjust their displays to an appropriate brightness in order to increase the use time of an entire system.

Typically, the current consumed by a planar display is increased with a higher brightness displayed on the display. For example, a higher brightness indicates a higher current consumed by a backlight for an LCD at the same gray scale. In an OLED display, a higher brightness indicates that a current consumed is increased at a single display pixel.

Existing brightness control methods for a display include: (a) automatically reducing a backlight brightness or closing the backlight after certain use-suspended time is counted to accordingly save power; and (b) calculating brightness distribution statistics of a frame in an operation mode of a display, for example, reducing the backlight brightness when most gray values of the frame are concentrated on the darker image regions (such as most gray values are smaller than 50) in a video playing mode. Conversely, when most gray values of the frame are concentrated on the light image regions, the backlight brightness remains in the normal mode, such that human eyes are insensitive to the poor frame quality produced by the reduced brightness. However, the method (A) directly affects the entire frame's brightness and can save power only at an idle mode. In addition to calculating the brightness distribution statistics, the method (B) needs a frame buffer to store the entire frame, which makes the circuit design become relatively complex and increases the system cost.

Therefore, it is desirable to provide an improved method to mitigate and/or obviate the aforementioned problems.

SUMMARY OF THE INVENTION

An object of the invention is to provide a brightness control method and device for a display, which can dynamically adjust image contrast and brightness in accordance with a brightness distribution of an input image.

An object of the invention is to provide a brightness control method and device for a display, which can avoid a brightness flicker otherwise produced by frames with intermittent scenes.

A further object of the invention is to provide a brightness control method and device for a display, which does not use a frame buffer to store the entire frame and accordingly the circuit design is simple and the system cost is low.

In accordance with one aspect of the invention, a brightness control method for a display is provided. The method includes: a receiving step, which receives a partial frame image; a statistic step, which calculates a brightness distribution of the partial frame image; a comparing step, which generates a comparative result from the brightness distribution of the partial frame image and a backlight brightness of the display; and a backlight brightness adjusting step, which adjusts the backlight brightness of the display in accordance with the comparative result.

In accordance with another aspect of the invention, a brightness control device for a display is provided. The device includes: a video stream histogram unit, which receives a partial frame image and calculates a brightness distribution of the partial frame image; a dynamic range calculation module, which determines a brightness of the partial frame image in accordance with the brightness distribution and determines if a backlight brightness of the display meets with the brightness of the partial frame image in order to generate a control signal; and a backlight pulse width modulation (PWM) controller, which adjusts the backlight brightness of the display in accordance with the control signal.

Other objects, advantages, and novel features of the invention will become more apparent from the following detailed description when taken in conjunction with the accompanying drawings.

DETAILED DESCRIPTION OF THE PREFERRED EMBODIMENT

The invention is achieved by calculating a proportion of high light regions of partial image. Namely, if the number of pixels in high light parts of consecutive horizontal scan lines is smaller than a predetermined value, a backlight brightness is gradually reduced to thus save backlight power consumption.

Figure 1:
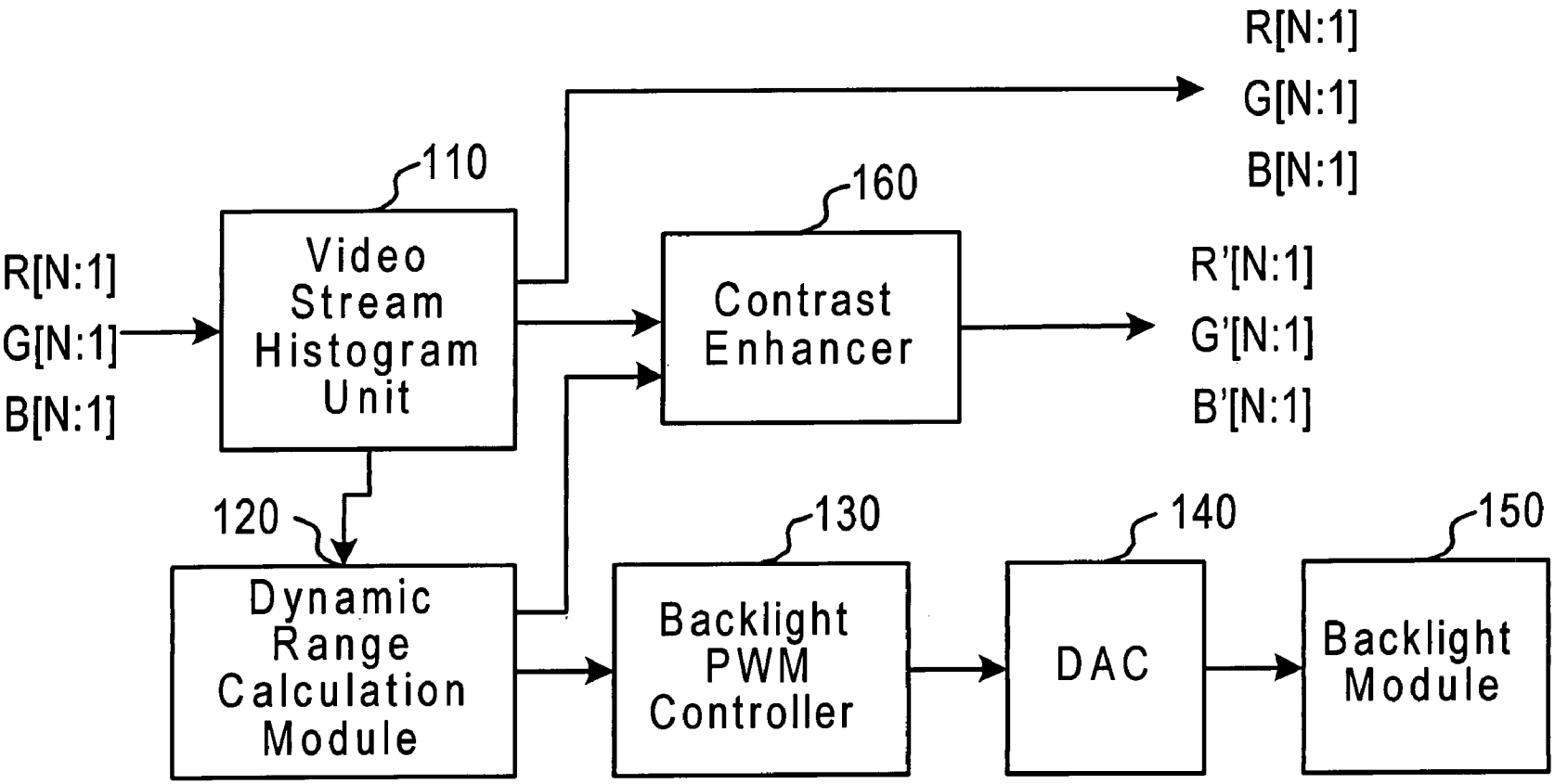
FIG. 1 is a block diagram of an embodiment of the invention.

FIG. 1 is a block diagram of an embodiment of a brightness control device for a display in accordance with the invention. As shown, the device includes a video stream histogram unit 110, a dynamic range calculation module 120, a backlight pulse width modulation (PWM) controller 130, a digital to analog converter (DAC) 140, a backlight module 150 and a contrast enhancer 160.

As shown in FIG. 1, the video stream histogram unit 110 receives image information, i.e., RGB values, in order to perform statistical processing on partial frame, and thus finds a histogram from the partial frame that meets with the predetermined value. The dynamic range calculation module 120 receives the histogram output from the video stream histogram unit 110, determines to adjust a backlight processing or not in accordance with the histogram received, and accordingly outputs a control signal. The pulse width modulation (PWM) controller 130 regulates a width of a PWM signal in accordance with the control signal and outputs the PWM signal. The digital to analog converter (DAC) 140 converts the PWM signal into an analog signal to thus control the brightness of the backlight module 150. The contrast enhancer 160 adjusts the RGB values of each pixel of the partial frame to thus enhance a contrast of the partial frame. The contrast enhancer 160 receives the RGB values of each pixel of the partial frame, and the contrast enhancer 160 rescales amplitudes of RGB values to generate R', B', and G' for improving the contrast of each pixel.

The contrast enhancer 160 is an optional unit and can be eliminated in another embodiment, and the DAC 140 can be replaced by a low pass filter (LPF).

Figure 2:
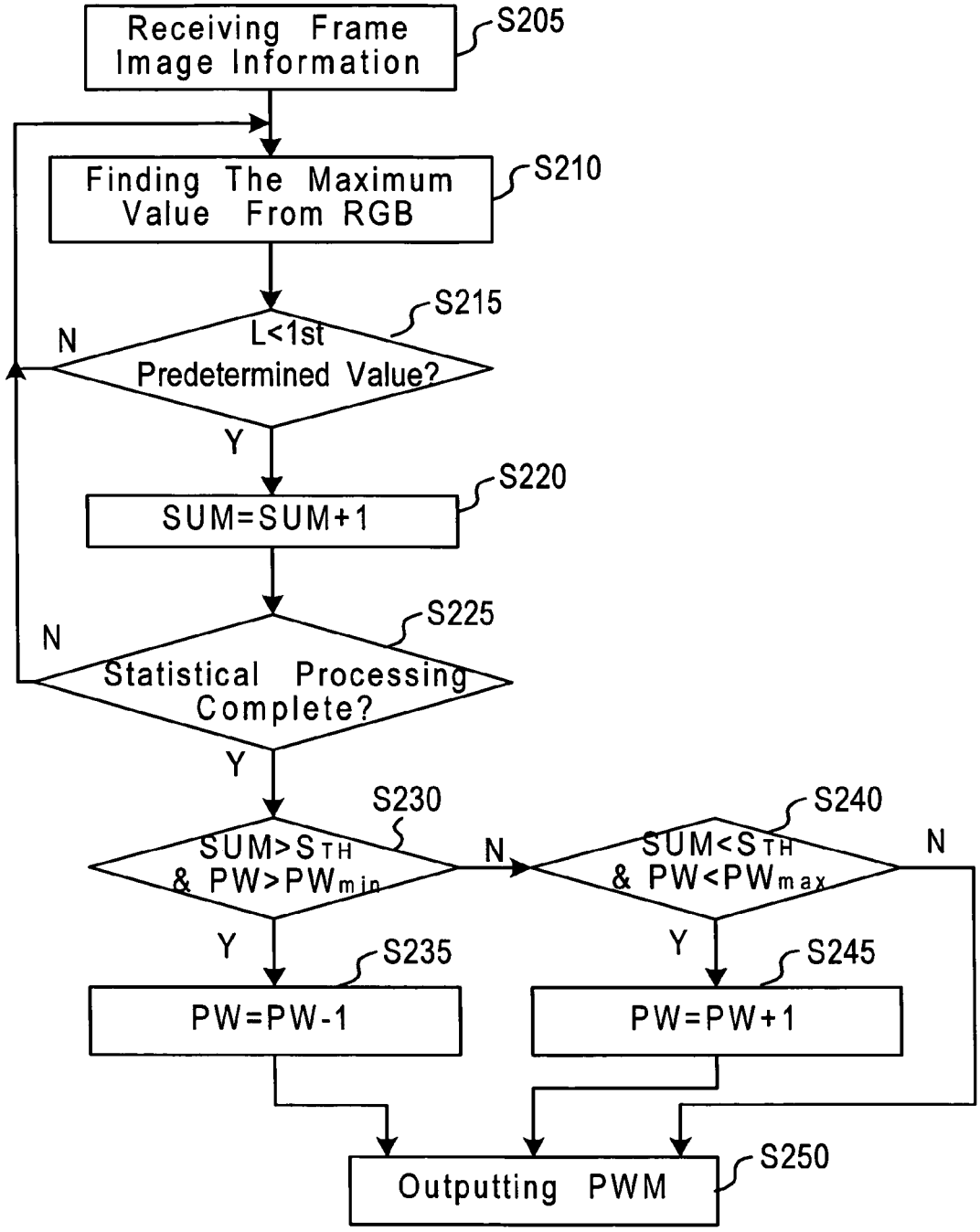
FIG. 2 is a flowchart of an embodiment of the invention.

FIG. 2 is a flowchart of a method for a display in accordance with the invention. Referring to FIGS. 1 and 2, in step S205, the video stream histogram unit 110 receives partial frame image information. In this case, the partial frame image information is a horizontal scan line, but it can be a half of a horizontal scan line, a plurality of pixels (such as 200 dots), a plurality of consecutive horizontal scan lines or a segment of a frame in other embodiments. In step S210, the video stream histogram unit 110 finds the maximum value L from the RGB values of each pixel. For example, a pixel has the RGB values respectively of 50, 100, 160, and the maximum value L for the pixel is 160.

In step S215, the video stream histogram unit 110 determines if the L value is smaller than a first predetermined value (such as 64); if yes, it indicates the pixel tends to being dark. Step S220 accumulates the number of pixels tending to be dark, and thus obtains an accumulated dark number SUM. Conversely, if the L value is greater than the first predetermined value, step S210 is executed.

Step S225 determines if the statistical processing on the partial image is complete; if not, step S210 is executed to proceed with the accumulation. Conversely, if the statistical processing on the partial image is complete, step S230 is executed.

In step S230, the dynamic range calculation module 120 determines if the accumulated dark number SUM is greater than a second predetermined value $S_{TH}$ (such as 500) and the width of the PWM signal is greater than a third predetermined value PWmin (minimum backlight brightness tolerance, such as 88); if yes, step S235 is executed; and if not, step S240 is executed.

Because pixels of the partial frame image that tend to be dark exceed the second predetermined value $S_{TH}$ (500) and the width of the PWM signal is greater than the third predetermined value PWmin, i.e., the partial frame image tends to be dark but the brightness of the backlight module is higher, step S235 accordingly reduces the brightness of the backlight module 150. At this time, the width of the PWM signal is reduced in order to lower the brightness of the backlight module 150.

Step S240 determines if the accumulated dark number SUM is smaller than the second predetermined value $S_{TH}$ (500) and the width of the PWM signal is smaller than a fourth predetermined value PWmax (maximum backlight brightness tolerance); if yes, step S245 is executed; and if not, step S250 is executed.

Because the pixels of the partial frame image that tend to be dark do not exceed the second predetermined value $S_{TH}$ (500) and the width of the PWM signal is smaller than the fourth predetermined value PWmax, i.e., the partial frame image tends to be light but the brightness of the backlight module is lower, step S245 accordingly increases the brightness of the backlight module 150. At this time, the width of the PWM signal is increased to increase the brightness of the backlight module 150.

After the regulating of the width of the PWM signal is complete step S250 is executed to output an adjusted PWM signal to the DAC 140 to control the brightness of the backlight module 150. Thus, the brightness of the backlight module 150 is dynamically adjusted with different playing frames, thereby reducing system power consumption.

The above embodiment is based on the accumulated number of dark dots in the partial image, but instead the accumulated number of light dots in the partial image can be used.

Figure 3:
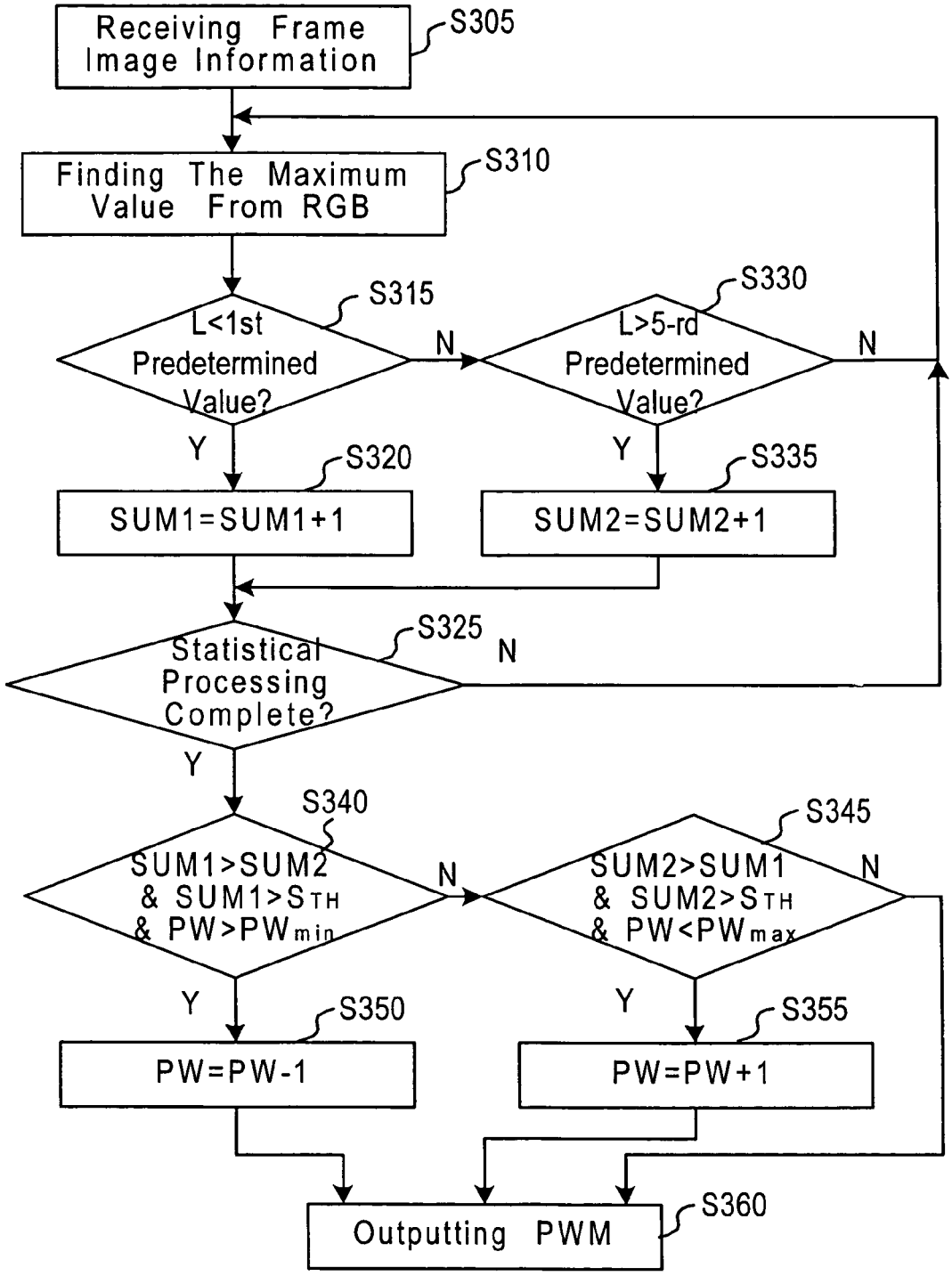
FIG. 3 is a flowchart of another embodiment of the invention.

FIG. 3 is a flowchart of another embodiment of the invention. As shown in FIG. 3, steps S305-S325 and S350-S360 are similar to steps S205-S225 and S230-S250 of FIG. 2, and thus not described further. In this embodiment, step S330 determines if the L value is greater than a fifth predetermined value (such as 196); if yes, it indicates that the pixel tends to be light, and accordingly accumulates the number of light dots, thereby obtaining an accumulated light number SUM2.

Step S340 determines if an accumulated dark number SUM1 is greater than the accumulated light number SUM2 and the accumulated dark number SUM1 is greater than the second predetermined value $S_{TH}$ (500), and the width of the PWM signal is greater than the third predetermined value PWmin; if yes, it indicates that the partial frame image has more dark dots (pixels). In this case, the width of the PWM signal is reduced to reduce the brightness of the backlight module 150 (step S350).

Step S345 determines if the accumulated light number SUM2 is greater than the accumulated dark number SUM1 and the accumulated light number SUM2 is greater than the second predetermined value $S_{TH}$ (500), and the width of the PWM signal is greater than the fourth predetermined value PWmax; if yes, it indicates that the partial frame image has more light dots (pixels). In this case, the width of the PWM signal is increased to increase the brightness of the backlight module 150 (step S355).

In view of foregoing, it is known that the invention can dynamically adjust contrast and brightness of an input image in accordance with a brightness distribution of the input image. In addition, the backlight brightness is gradually adjusted to accordingly avoid a brightness flicker on a frame presented at intermittent scenes, without using a frame buffer. Accordingly, the inventive circuit is simpler and costs less than the prior art.

Although the present invention has been explained in relation to its preferred embodiment, it is to be understood that many other possible modifications and variations can be made without departing from the spirit and scope of the invention as hereinafter claimed.

What is claimed is:

1. A brightness control device for a display, comprising:

a video stream histogram unit, which receives a partial frame image and calculates a brightness distribution of the partial frame image;

a dynamic range calculation module, which determines a brightness of the partial frame image in accordance with the brightness distribution, and determines if a backlight brightness of the display meets with the brightness of the partial frame image in order to generate a control signal, wherein the backlight brightness is reduced when the brightness distribution of the partial frame image tends to be dark and the backlight brightness is greater than a third predetermined value, or the backlight brightness is increased when the brightness distribution of the partial frame image tends to be light and the backlight brightness is smaller than a fourth predetermined value; and a backlight pulse width modulation (PWM) controller, which adjusts the backlight brightness of the display in accordance with the control signal.

2. The device as claimed in claim 1, wherein the partial frame image is a plurality of pixels or a segment of the frame.

3. The device as claimed in claim 1, wherein the video stream histogram unit calculates a quantity of dark dots of the partial frame image or a quantity of light dots of the partial frame image.

4. The device as claimed in claim 1, wherein the video stream histogram unit finds a respective maximum value among RGB values of each pixel from the partial frame image and further compares the respective maximum value with a first predetermined value.

5. The device as claimed in claim 1, further comprising:

a digital to analog converter connected to the backlight PWM controller for converting a digital backlight pulse width modulation signal which is outputted from the backlight PWM controller to an analog backlight pulse width modulation signal.

6. The device as claimed in claim 5, further comprising:

a contrast enhancer, connected to the video stream histogram unit and the dynamic range calculation module, for rescaling amplitude of each pixel of the partial frame image to improve contrast of each pixel.

* * * * *

UNITED STATES PATENT AND TRADEMARK OFFICE

CERTIFICATE OF CORRECTION

PATENT NO. : 7,612,758 B2
APPLICATION NO. : 11/311320
DATED : November 3, 2009
INVENTOR(S) : Ho-Hsing Yang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 987 days.

Signed and Sealed this

Nineteenth Day of October, 2010

David J. Kappos

David J. Kappos
*Director of the United States Patent and Trademark Office*